US006681459B1

(12) United States Patent
Curet et al.

(10) Patent No.: US 6,681,459 B1
(45) Date of Patent: Jan. 27, 2004

(54) ADJUSTABLE SHOELACE

(75) Inventors: William D. Curet, Lake Charles, LA (US); Gregory S. Smith, Dunwoody, GA (US)

(73) Assignee: Sporting Innovations Group, LLC, Atlanta, GA (US)

( * ) Notice: Subject to any disclaimer, the term of this patent is extended or adjusted under 35 U.S.C. 154(b) by 0 days.

(21) Appl. No.: 09/907,382

(22) Filed: Jul. 17, 2001

(51) Int. Cl.[7] ..... A43C 9/00; A43C 7/00; A44B 11/00

(52) U.S. Cl. ..... 24/712; 24/712.1; 24/712.3; 24/715.3; 24/715.4; 24/300; 36/50.1

(58) Field of Search ..... 24/712, 712.1, 24/713.6, 714.6, 715.3, 300, 715.6, 715.4; 36/50.1

(56) References Cited

U.S. PATENT DOCUMENTS 1,419,370 A * 6/1922 Genaille ..... 24/300
2,581,366 A * 1/1952 De Grazia ..... 24/712
2,820,269 A * 1/1958 Wolff ..... 24/300
4,423,539 A * 1/1984 Ivanhoe ..... 24/712
4,969,242 A * 11/1990 Carlton, Sr. ..... 24/712.3
5,287,601 A * 2/1994 Schweitzer et al. ..... 24/715.3
5,388,315 A * 2/1995 Jones ..... 24/712.1
5,619,778 A * 4/1997 Sloot ..... 24/715.4

* cited by examiner

*Primary Examiner*—Victor Sakran
(74) *Attorney, Agent, or Firm*—Nelson Mullins Riley & Scarborough

(57) ABSTRACT

A stretchable string (100) having a first cross sectional diameter at rest and a second smaller cross sectional diameter when stretched. An aglet (200) positioned on the string. The aglet has an inner cross sectional diameter that is smaller than the cross sectional diameter of the string at rest and approximate to the cross sectional diameter of the string when it is sufficiently elongated. The aglet is moved along the string when the string is sufficiently elongated. The aglet can be repositioned along the string by stretching the string such that the diameter of the string is approximate to the inner diameter of the aglet. Excess string can then be removed.

14 Claims, 5 Drawing Sheets

ADJUSTABLE SHOELACE

BACKGROUND OF THE INVENTION

The proper length of a shoelace depends upon several factors such as the style and size of the shoe to be laced. For example, a "high top" basketball shoe typically requires longer laces than a "low top" shoe and a size 20 shoe needs longer shoelaces than a size 6 shoe. Even when two persons have the same style and size shoe, the personal preferences of the users often lead to different desired lengths of shoelaces. For example, a user's preferences regarding how to lace the shoe and how to tie the shoe affect the proper length of the shoelace.

It is difficult for shoe manufacturers to supply shoes with shoelaces which meet all the preferences of the many different potential shoe purchasers. Shoe manufacturers often try to provide laces which are of a length that is a "happy medium" between the longest and shortest lengths a customer may desire for a particular shoe. As a result, consumers are often faced with laces that are of an undesired length. This is not only an annoyance but can be dangerous if the shoes cannot be tied properly or are subject to coming untied, thus resulting in a tripping hazard or the possibility the shoelace may become entangled in machinery, a bicycle chain, etc. In addition, shoe manufacturers may lose sales of shoes due to improper shoelace length.

Currently, there is no convenient means by which a consumer or shoe manufacturer can readily alter the length of a shoelace, thereby allowing the use of "one size fits all" laces whose length can be adjusted, such as by a customer, according to the shoe style and size, the positions of the shoelace eyelets, the user's personal preferences, etc.

Shoelaces are typically manufactured with aglets affixed to the ends of the string. The aglets allow for the convenient lacing of the shoe by decreasing the diameter of the shoestring ends such that they can be conveniently threaded through the eyelets of the shoe. The aglets also prevent the wearing and fraying of the ends of the shoestrings. Thus, if a user attempts to shorten the length of a prior art shoelace, such as by cutting off an excess portion of the string, the aglet is removed, thus leaving the shoestring unprotected against wear and making it more difficult to lace as well as leaving an unattractive shoelace.

A person may decide to purchase new shoelaces if the current shoelaces are of improper length. However, it may prove difficult to find laces which match the style of the shoe and meet the required specifications. In addition, if new laces are purchased the user must remove the old laces and insert the new laces.

Thus, there is a need for a shoelace whose length is readily adjustable and which allows for the adjustment of aglets.

BRIEF SUMMARY OF THE INVENTION

The current invention provides an improved shoelace with adjustable aglets such that the length of the shoelace is readily adjustable, a method for adjusting the length of a shoelace, and an improved shoe incorporating the adjustable shoelace such that purchasers, of the shoe can adjust the shoelace length.

The apparatus of the current invention comprises an elastic string which is stretchable from a rest state to an elongated state. The string has a first cross-sectional area in its rest state and a smaller cross-sectional area when it is elongated. An aglet is positioned on the string such that a portion of the string resides within the aglet and a portion or portions of the string extend out from the open ends of the aglet. The inner surface of the aglet defines a receiving area or chamber for receiving the elastic string. The receiving chamber has an inner cross-sectional area that is smaller than the cross-sectional area of the string at rest.

When the string is in a rest state, i.e., not elongated, the cross section of the string that is not within the aglet is greater than the cross section of the receiving area of the aglet and the portion of the string within the aglet is compressed by the inner wall of the aglet. The aglet is therefore held in place on the string when the string is in a rest state.

When a portion of the string is stretched or elongated, the stretched portion's cross section decreases such that is approximate to the cross section of the receiving area of the aglet. The aglet can then be readily moved along the elongated portion of the string to a desired position according to the preferences of the user. When the aglet is in the desired position, the string can then be returned to a rest state, thereby returning the cross-section of the string to its larger rest value and holding the aglet in place. The excess amount of string extending from the aglet to the end of the string can then be removed. Thus a shoestring of proper length having an aglet at the end is achieved.

In one embodiment of the invention, the interior of the aglet has ribs, catches, pins, or other means which restricts the movement of the aglet in one direction along the string while allowing the aglet to be readily moved along the string in the opposite direction or restricts the movement in both directions. Preferably, the aglet is placed near the end of the string and the ribs are positioned such that the aglet can be moved towards the interior or center of the string but not toward the end of the string. This allows for a wide range of adjustments of the string length while preventing the aglet from being completely removed from the string.

The current invention also provides a method for adjusting the length of shoelaces. The method comprises the steps of attaching the aglet to an elastic string where the string has a first cross-sectional diameter at rest and, as the string is stretched, the cross-sectional diameter string decreases such that it has a second smaller cross-sectional area. The aglet has open ends and defines an inner receiving area whose cross section is less than the cross-section of the string in a rest state.

The desired length of the shoelace is then determined. The string is then stretched, thereby decreasing the cross-section of a portion of the string including the portion within the aglet, preferably to a size approximate to the cross-sectional diameter of the receiving area of the aglet. The aglet is then moved along the portion of the string having the decreased cross section to a desired position. The aglet may be moved in either direction along the string, or the aglet may be limited to movement in a single direction by internal ribs or other means. After the position of the aglet has been finally adjusted, the excess string exterior to the aglet is then removed.

The current invention also relates to a shoe which is laced with the elastic shoestring and adjustable aglet and a method for adjusting the length of a shoelace after lacing the shoe with the string.

It will be understood that for simplicity the embodiments discussed below use the term "diameter" and discuss the cross-sectional diameter of the string and cross-sectional diameter of the receiving area of the aglet. However, it will be understood that the string and the aglet may have various cross-sectional shapes and that the term diameter is used to mean the size of the cross section of the string and the inner receiving area of the aglet such that the difference in sizes determines the ability to move the aglet along the string.

DETAILED DESCRIPTION OF THE INVENTION

Figure 1:
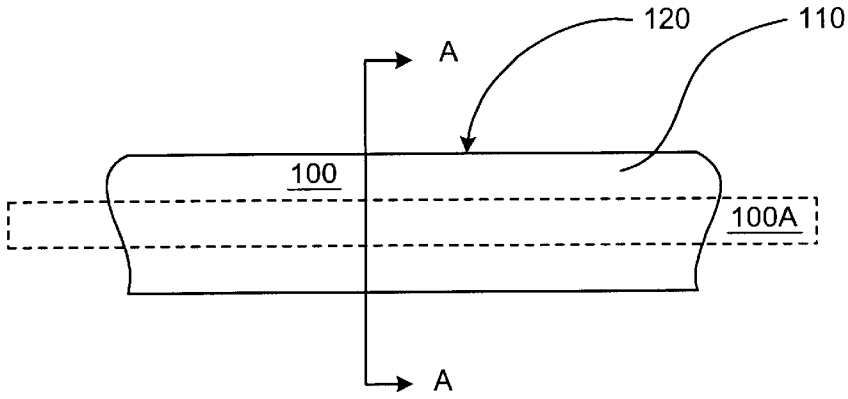
FIG. 1 shows the elastic string of the present invention.
Figure 2A:
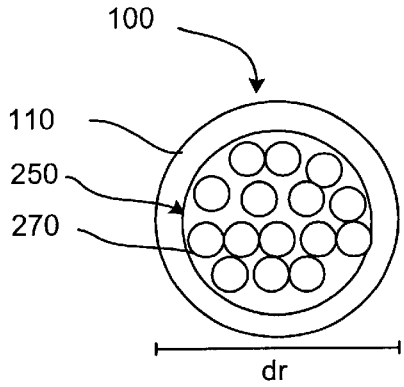
FIGS. 2A and 2B show a cross-section about line A—A of the string in FIG. 1.
Figure 2B:
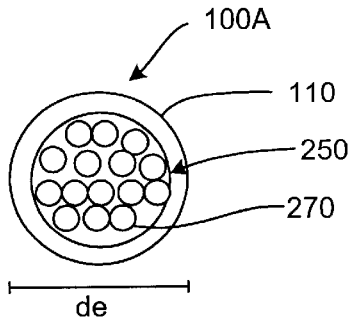

FIG. 1 shows an elastic string 100 of the current invention. As shown in FIGS. 1 and 2 the string 100 has an outer cover 110 which surrounds an inner core 250. The string 100 is stretchable from a rest state (shown as a solid line in FIG. 1) to an elongated state 100' (shown as a dashed line in FIG. 1). As shown in FIG. 2A string 100 has a rest diameter dr. As shown in FIGS. 1 and 2B when string 100 is elongated, the string 100A has a decreased cross sectional diameter de. Thus, as shown in dashed line in FIG. 1, when sufficient forces are applied to a portion 120 of the string 100, the portion 120 stretches and its diameter decreases.

Figure 3:
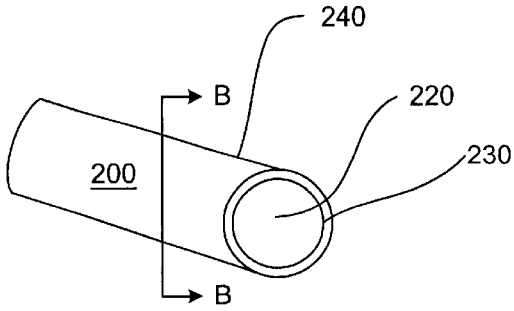
FIG. 3 shows an aglet of the current invention.
Figure 4:
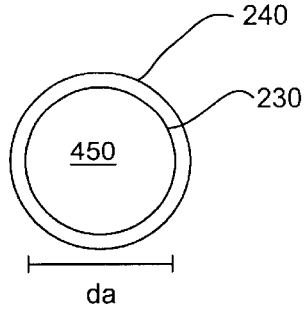
FIG. 4 shows the cross-section of the aglet of FIG. 3 about line B—B.

FIG. 3 shows the aglet 200 of the current invention. The aglet 200 has outer shell 240 with inner wall 230 and open ends 220 for receiving the string 100. The inner wall 230 of the aglet 200 defines a receiving area 450 (FIG. 4) for receiving string 100. The receiving area 450 has an inner diameter da. The inner diameter da of the receiving area 450 is less than the outer diameter dr of the string 100 in a rest state. The difference between da and dr is significant enough to create a sufficient amount of friction between the outer edge 110 of string 100 and the inner surface 230 of the aglet 200, when the string 100 is within the aglet 200, to prevent the aglet 200 from being easily pulled from the string 100. The aglet 200 is preferably made of hard plastic and is approximately one-half inch long with an inner diameter of approximately 1/10 of an inch in diameter. In the preferred embodiment the aglet is cylindrical in shape. However, the aglet may be of other shapes but preferably corresponds to the shape of the cross section of the string 100.

Figure 5:
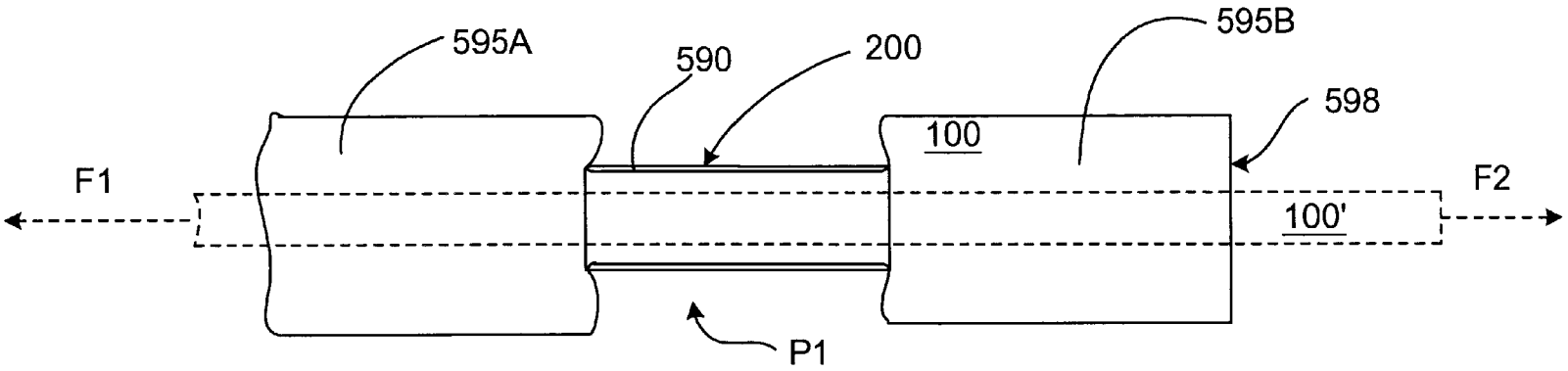
FIG. 5 shows the aglet on the string.

FIG. 5 shows aglet 200 on string 100 at position P1 near end 598 of the string 100 when the string 100 is at rest. A portion 590 of the string is held within the aglet 200 and portions 595A–B of the string are outside the aglet 200. Thus, portion 590 is compressed within the aglet 200. Portions 595A–B, however are not compressed and have a diameter of dr which is larger than the diameter da of the aglet 200. Thus, the aglet 200 is held in place at position P1 by the force of portion 590 against the interior wall 230 of the aglet 200 as well as by portions 595 which abut against rim of the openings 220 of the aglet. As shown in FIG. 5, the aglet is preferably initially located at a position that is near the end 598 of the string 100. This allows for a sufficient amount of string 100 to be gripped on each side of the aglet 200 so that the string 100 can be conveniently stretched.

Figure 6:
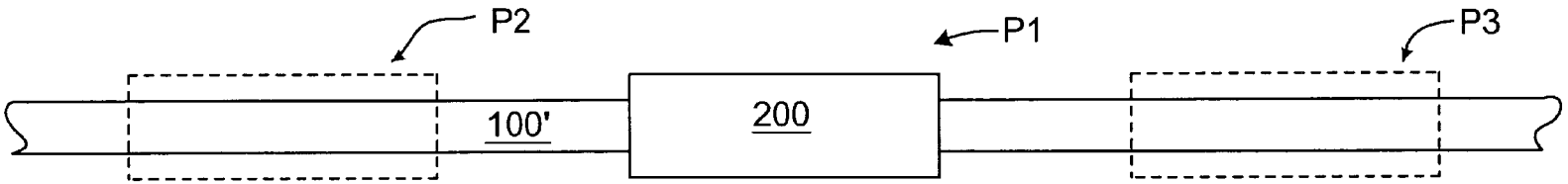
FIG. 6 show the aglet on the string when the string is in an elongated state.

FIG. 6 shows the aglet 200 on string 100 when the string is elongated. The outer diameter of the string de is decreased such that aglet 200 may be moved to new positions P2 and/or P3 along string 100.

Figure 7:
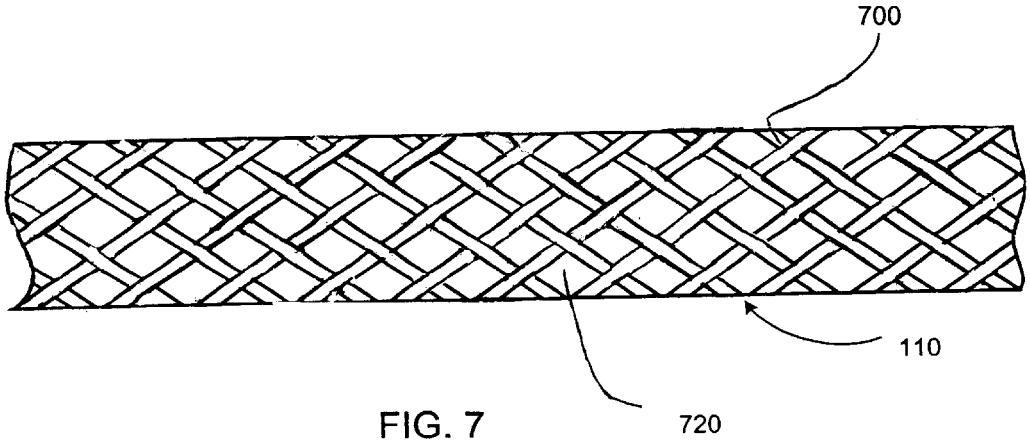
FIG. 7 shows the cover of the string when the string is elongated.

The string 100 may be made of a variety of materials. As shown in FIG. 2, in the preferred embodiment the string 100 has a core 250 which is surrounded by a cover 110. As shown in FIG. 7, in the preferred embodiment cover 110 is made of a plurality of intertwined threads 700 which form an extendible web. Preferably the threads 700 are made of nylon. As shown in FIG. 7, when the string 100 is stretched, the threads 700 extend such that gaps 720 are created between the threads 700. Thus, the cover 110 extends along with the inner core 250 when the string 100 is stretched. When the string 100 is returned to a rest state the cover 110 returns to a rest position and the gaps 720 are closed.

As shown in FIG. 2, in the preferred embodiment the core 250 is made of a plurality of parallel elastomeric strands 270. In the preferred embodiment 15 strands of rubber each having a diameter of about 0.025 inches are used. The strands may be grouped together in groups of various sizes. For example, the strands may be made of three groups of five strands each. The strands 270 may be grouped together by an adhesive or other means or may simply be held together by the outershell 110.

In the preferred embodiment the string 100 has an outer diameter of approximately 3/25 inches when at rest and a length of about three feet. This allows for a string which is sufficiently long for most users and which can be readily shortened to an appropriate length. In the preferred embodiment the string is strectchable such that a one inch portion of the string can be stretched to approximately 2.5 inches and the aglet can be readily moved along the string.

In a preferred embodiment the aglet 200 is approximately one-half inch in length with an internal diameter of approximately less than 1/10 inch. No adhesive is used to fix the aglet on the string 100. However, the ends 598 of the string 100 may be glued or otherwise sealed to prevent wear. In a preferred embodiment the ends of the strings are heat sealed.

In the preferred embodiment the entire string 100 is elastic. However, the string 100 could be made of multiple sections, where the sections are of different material some of which are stretchable and some which are not. For example, a center portion of the string 100 could be made of non-strectchable material and the outer portions could be made of stretchable material. Thus, the center portions which are laced through the eyelets of a shoe would not be stretchable, but the portions of the string exterior of the eyelets could be stretched and the aglets readily adjustable on those outer portions.

Figure 9:
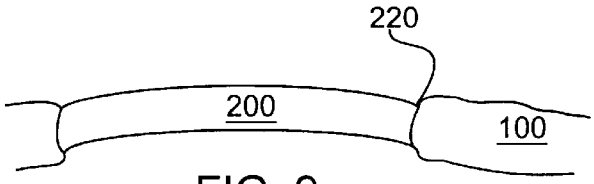
FIG. 9 shows an embodiment of the aglet in which the aglet is curved.

FIG. 9 shows an alternative embodiment of the aglet 200 in which the aglet 200 is curved. The curvature of the aglet 200 allows the aglet to remain in place as the string 100 is forced to fit the curve of the aglet 200. In addition, the outer surface of the aglet at openings 220 digs into the cover 110 of the string 100.

Figure 10:
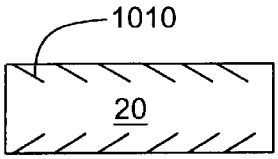
FIG. 10 shows an embodiment in which the aglet has ribs.

FIG. 10 shows another embodiment in which the aglet 200 has inner ribs 1010. The ribs 1010 extend inwards from the inner surface 230 of the aglet 200 at an acute angle, i.e., the ribs do not extend perpendicular to the string. The angle of the ribs 1010 determine in which direction the aglet 100 may move by gripping the string in one direction. Preferably the ribs extend at about a 45 degree angle from the inner surface of the aglet. The ribs are preferably made of the same material as that of the aglet but may be made of some other sufficiently durable material.

Figure 11:
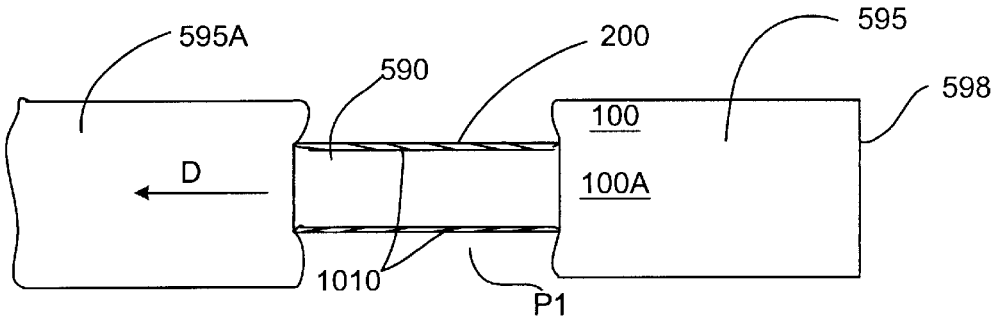
FIG. 11 shows an aglet with ribs on the string.

FIG. 11 shows the aglet 200 with ribs 1010 positioned on string 100. As shown in FIG. 11 when string 100 extends through aglet 200 the ribs 1010 are compressed. In the example shown in FIG. 11 the ribs 1010 allow for the aglet 200 to be moved in the right to left direction (D). However, the ribs prevent the movement of the aglet in the opposite direction (left to right) as such movement would push the ribs 1010 into the cover 110 of the string 100.

Figure 12A:
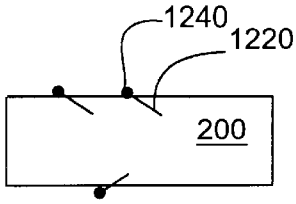
FIGS. 12A and 12B show an aglet with pins.
Figure 12B:
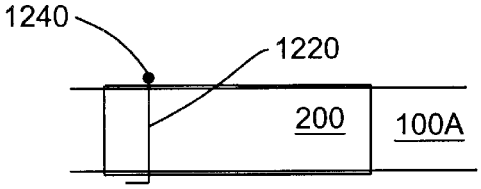

Other means for preventing the aglet from moving in a particular direction may also be used. For instance, a hinged member or door could be mounted to the interior of the aglet such that the door only opens in a single direction. As shown in FIGS. 12A and 12B, in an alternative embodiment, a single or multiple pins 1220 may be used rather than the ribs 1010. The pins 1220 may be formed into the aglets 200 during manufacture or may be entered into the aglets 200 after manufacture. The pin may be inserted through the edge of the shell 240 of the aglet 200 at an angle similar to that of the ribs (FIG. 12A), or may pass through two edges of the shell 240 of the aglet 200 (FIG. 12B), piercing the string 100. The pin 1220 may have a head 1240 at one end to prevent it from entering the interior of the aglet and then bent or cropped on the other end in the embodiment that passes through the edges of the aglet 200 (FIG. 12B).

The ability to adjust the position of the aglet 200 along the string 100 allows for the length of string 100 to be adjusted to a preferred length while maintaining aglets 200 on the string 100. A method of adjusting the length of a shoelace 100 will now be described. As shown in FIG. 5 aglet 200 is placed on string 100 at position P1. The aglet 200 may be placed on the string 100 by a variety of means. In the preferred embodiment two halves of the aglet 200 are placed over the string 100 and sealed together such as by thermowelding. As discussed above, the internal diameter of the aglet 200 is less than the outer diameter dr of the string 100 at rest. Therefore, the aglet 200 is held in place at position P1 when the string 100 is at rest.

Preferably, the aglet 200 is placed near the end 598 of the string 100, preferably about one inch from the end 598. This provides for a sufficient gripping area near the end of the string 100.

In a preferred embodiment two aglets 200 are used, one near each end 598 of the string 100. In another embodiment, an aglet is permanently affixed to the end 598 of the string 100 and a second, moveable aglet 200 is placed at the other end 598 of the string 100. This allows for the adjustment of the string 100 by moving the moveable aglet 200.

If the string 100 will be laced through the shoe 800 before adjusting the length, then an adjustable aglet 200 at each end is preferable so as to allow for adjustment without having to relace the shoe 800. In another embodiment of the method, the string 100 is first laced through the apertures 810 of a shoe prior to adjustment.

Figure 8A:
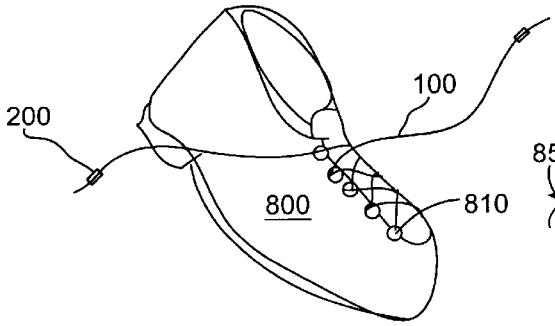
FIGS. 8A–8C show a shoe with the elastic string and aglet of the present invention.
Figure 8B:
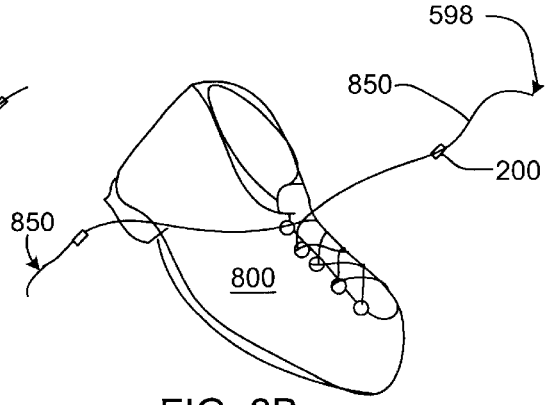
Figure 8C:
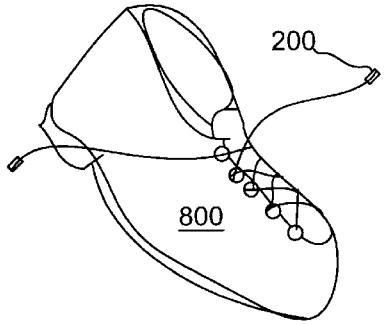

After the aglet 200 is placed on the string 100, the proper length of the string 200 is determined. In one embodiment the string is laced though apertures 810 in shoe 800 (FIG. 8A). Thus, a user can lace the shoe 800 to determine the appropriate length of the string. After the desired length of the string has been determined the string 100 is stretched such that the outer diameter of the string decreases and the aglet 200 can be moved along the string 100, preferably the string is stretched so that the diameter of the string is less than or approximate to the inner diameter of the aglet 200 (FIG. 6). The aglet 200 is then moved to the desired position on the string (FIGS. 6 and 8B). The excess string 850 extending from the outer end of the aglet 200 to the end of the string 598 can then be removed. The aglet 200 is then held in place by the outer portion of the string 100 pushing against the inner surface 230 of the aglet 200, as well as the ribs 1010 or member holding the aglet in place (if applicable) (FIG. 8C). Thus, the aglet 200 is prevented from being removed from the string 100.

Although the present invention has been described with particularity, the invention may be implemented in ways other than the ones described above by a person skilled in the art without departing from the scope of the present invention, as defined by the appended claims.

What is claimed is:

1. A shoelace comprising:

an elastic string having a first cross sectional area in a rest state and a second cross sectional area in an elongated state; and an aglet, said aglet defining a receiving chamber for receiving said string and positioned on said string such that said string extends at least partially through said aglet, said receiving chamber having a cross sectional area;

wherein said first cross sectional area of said string is greater than said cross sectional area of said receiving chamber to prevent movement of said aglet along said string when said string is in a rest state, and said second cross sectional is of a reduced size to allow movement of said aglet along said string when the string is in an elongated state.

2. The shoelace of claim 1 wherein said aglet is curved.

3. The shoelace of claim 1 wherein said elastic string comprises:

an inner core of elastomeric strands; and an outer cover surrounding said core, said cover comprising a plurality of intertwining threads.

4. The shoelace of claim 1 wherein said aglet further comprise at least one rib extending from an interior surface of said aglet, said rib being operative to prevent movement of the aglet in one direction along said string.

5. The shoelace of claim 1 wherein said aglet further comprise a hinged member attached to the inner surface of said aglet.

6. The shoelace of claim 1 wherein said aglet further comprises a pin that protrudes through at least one surface of the aglet and prevent the movement of the aglet along the string in at least one direction.

7. A shoelace comprising:

an elastic string having a first cross sectional area at rest and a second cross sectional area when elongated, said string comprising:

an inner core of elastomeric strands, and an outer cover surrounding said core, said cover comprising a plurality of intertwined threads forming an extendible web;

at least one aglet positioned on said string, said aglet being curved and defining a receiving chamber for receiving said string, said receiving chamber having a cross section, wherein said inner cross section of said receiving chamber is approximate than said first cross sectional area of said string and greater than said second cross sectional area of said string.

8. A shoe lace comprising:

a. an elastic string having a first end and a second end, said elastic string defining a first circumference in a state of rest and a second circumference in a stretched state;

b. a first sleeve having a first open end and a second open end, said first sleeve defining an inside circumference that is larger than said second circumference but smaller than said first circumference, wherein said first sleeve is positioned on said elastic string proximate said string first end so that said first sleeve first open end is closest to said string first end; and c. a second sleeve having a first open end and a second open end, said second sleeve defining an inside circumference that is larger than said second circumference but smaller than said first circumference, wherein said first sleeve is positioned on said elastic string proximate said string second end so that said second sleeve first open end is closest to said string second end, wherein said first and said second sleeve are moveable along said elastic string to respective first and second positions when said shoe lace is in said stretched state and immoveable from said positions when said elastic string is in said rest state so that said first end of said elastic string can be cut to a desired length adjacent to said first sleeve first end and said second end of said elastic string can be cut to a desired length adjacent to said second sleeve first end so that said first sleeve binds said elastic string first end and said second sleeve binds said elastic string second end.

9. The shoe lace in claim 8, wherein said first and said second sleeve are formed from a polymer.

10. The shoe lace in claim 8, wherein said first and said second sleeve are formed from a metal.

11. The shoe lace in claim 8, said first and said second sleeve each contains at least one radially inward pointing rib.

12. The shoe lace in claim 8, said elastic string comprising:

a. an inner core of elastic strands; and b. an outer covering surrounding said strands.

13. The shoe lace in claim 8, wherein said first and said second sleeve have a cylindrical cross-section.

14. The shoe lace in claim 8, wherein said first and said second sleeve are curved in a longitudinal direction.

* * * * *